United States Patent [19]

Jawdoszyn

[11] 4,049,932

[45] Sept. 20, 1977

[54] SAFETY DEVICE FOR A ROTARY STARTER SWITCH FOR AN AUTOMOBILE VEHICLE

[75] Inventor: Claude Jawdoszyn, Bois-Colombes, France

[73] Assignee: Neiman, S.A., Courbevoie, France

[21] Appl. No.: 685,472

[22] Filed: May 12, 1976

[30] Foreign Application Priority Data

June 4, 1975 France ..... 75.17375

[51] Int. Cl.[2] ..... H01H 27/00

[52] U.S. Cl. ..... 200/44; 74/6; 200/153 B

[58] Field of Search ..... 200/42 R, 44, 153 B; 74/6; 123/146.5 B; 180/82

[56] References Cited

U.S. PATENT DOCUMENTS

| | | | |
|---|---|---|---|
| 1,865,389 | 6/1932 | Reddy | 200/153 B |
| 2,031,202 | 2/1936 | Bier | 200/153 B |
| 3,172,968 | 3/1965 | Arendt | 200/44 X |
| 3,359,383 | 12/1967 | Cryer | 200/42 R |
| 3,622,716 | 11/1971 | Rushton | 200/44 |
| 3,632,916 | 1/1972 | Shaad | 200/44 X |
| 3,819,883 | 6/1974 | Heap | 200/44 X |
| 3,819,887 | 6/1974 | Lipschutz | 200/44 |

FOREIGN PATENT DOCUMENTS

| | | | |
|---|---|---|---|
| 2,127,164 | 10/1972 | France | 200/153 B |

*Primary Examiner*—Thomas J. Kozma
*Attorney, Agent, or Firm*—Nolte and Nolte

[57] ABSTRACT

A safety device for a rotary starter switch for an automobile vehicle, of the type comprising a non-rotatable part and a part which is rotatable with respect to the non-rotatable part about an axis of revolution. The safety device comprises elastically yieldable means connected to one of the two parts and a profile integral with the other part and constraining said elastically yieldable means to travel through two different paths depending on the direction of rotation, one of which paths has an anti-return abutment. Said elastically yieldable means comprise a spring blade so disposed as to be cooperative by its edge with said anti-return abutment.

7 Claims, 6 Drawing Figures

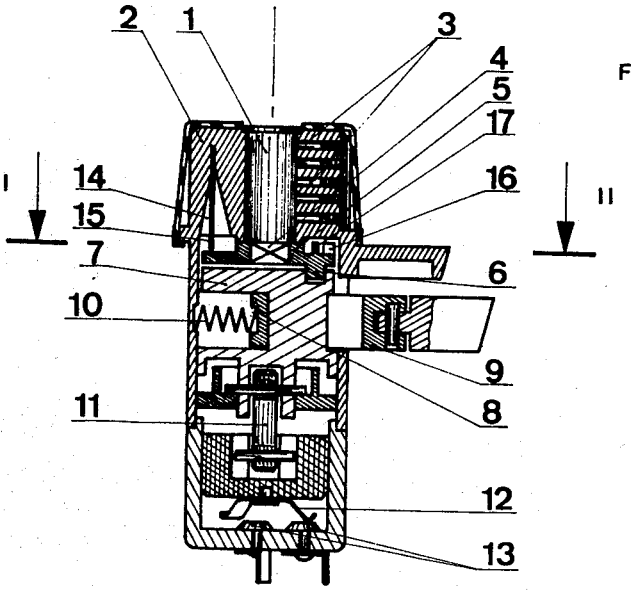
FIG. 1
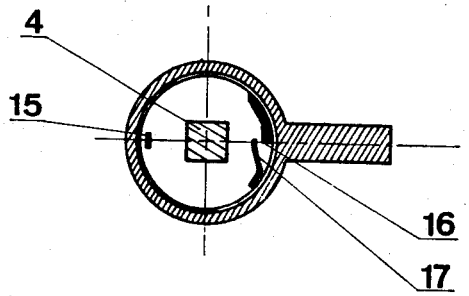
FIG. 2
FIG. 3
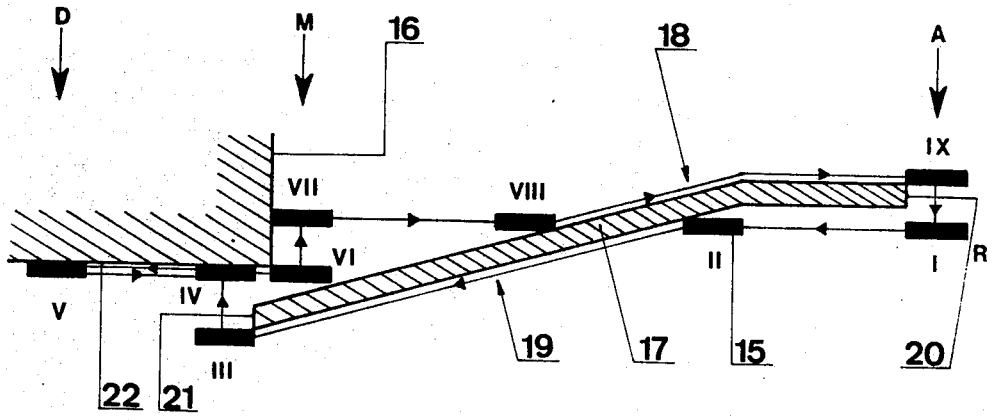

SAFETY DEVICE FOR A ROTARY STARTER SWITCH FOR AN AUTOMOBILE VEHICLE

BACKGROUND OF THE INVENTION

Starters for automobile vehicles are mostly actuated by a rotary switch which is usually combined with a barrel-type lock controlling an anti-theft device, such as a bolt member which locks the steering column.

It is very important to arrange that the starter cannot be actuated accidentally while the engine of the vehicle is running, since the starter mechanism might be damaged thereby. It is known to provide, for this purpose, the switch or the lock combined therewith, with a device which precludes bringing the switch to the starting position before passing through a position in which the electric power supply to the engine is cut off, which stops the engine if it was running. Such devices are known, some of which are purely electrical, some purely mechanical and others electro-mechanical.

Mechanical devices have been proposed which comprise a member slidable between two positions in a recess and blocking the switch in one direction of rotation in one of its two positions so that the slidable member must be returned to the other position before it is possible to pass to the starting position (see, for example, French Pat. No. 1,547,973 and German Pat. No. 1,776,131).

These known devices have many parts of precise dimensions and fitting and are consequently expensive, difficult to assemble and subject to wear.

An elastically yieldable lug has also been proposed (see French Pat. No. 2,127,164) which is axially guided by a helical ramp which brings the lug in front of an abutment if the switch is not first moved to the "off" position. This device is also rather complicated to assemble and the strength of the abutment in rotation is not always sufficient in that it is ensured by a sliding member returned by a spring.

An object of this invention is to avoid the drawbacks of known mechanical safety devices and to provide an extremely simple novel device which allows wide tolerances and has very high strength.

According to the present invention, there is provided a safety device for a rotary starter switch for an automobile vehicle, of the type comprising a non-rotatable part and a part rotatable with respect to the non-rotatable part about the axis of revolution, the safety device comprising elastically yieldable means connected to one of the parts and a profile integral with the other part and constraining said elastically yieldable means to move through two different paths depending on the direction of rotation, one of which paths has an anti-return abutment, wherein said elastically yieldable means comprise a spring blade so disposed as to be cooperative by its edge with said anti-return abutment.

The use of a spring blade permits a very simple assembly with wide tolerances having regard to the width of the blade. Moreover, the abutment of the blade by its edge provides exceptional strength.

The blade may be connected to rotate with the rotatable part or prevented from rotating relative to the fixed part. In the latter case, the blade may be integral with the fixed part or, by way of a modification, integral with a member which is movable with respect to the fixed part, for example integral with a locking bolt member.

The use of a spring blade also ensures various additional indexing functions.

BRIEF DESCRIPTION OF THE DRAWINGS

The invention will be understood from the ensuing description with reference to the accompanying drawings, in which:

FIG. 1 is an axial sectional view, partly in elevation, of an anti-theft device provided with a switch according to one embodiment of this invention;

FIG. 2 is a sectional view taken on line II—II of FIG. 1;

FIG. 3 is a developed diagrammatic view corresponding to FIG. 2;

DESCRIPTION OF THE PREFERRED EMBODIMENTS

Figure 4:
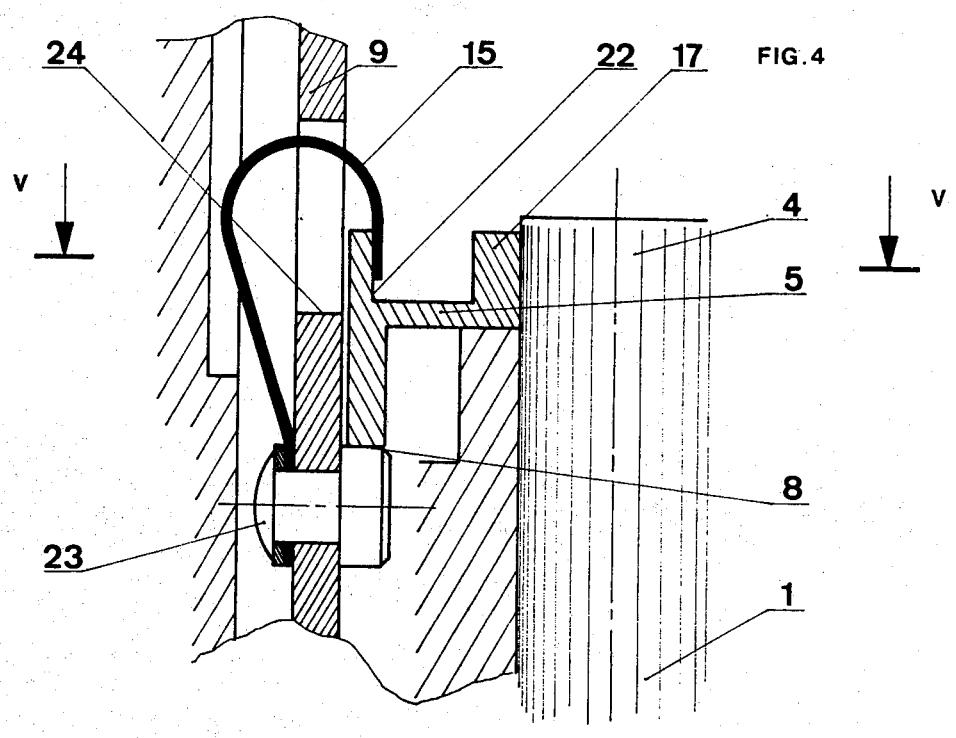
FIG. 4 is an axial sectional view of a part of a modification of the assembly shown in FIG. 1.

With reference first to FIGS. 1 and 2, the illustrated anti-theft device comprises a barrel 1, rotatable in a stator 2 which is provided with locking pistons 3 cooperating in the conventional manner with pistons of the barrel 1 to lock it with respect to the stator in the absence of a key. The barrel 1 drives in rotation, by its non-circular end portion 4, a disc 5 provided with an eccentric dog 6 which shifts a cam 7 having a radial profile 8 and cooperative with a center aperture of a locking bolt member 9 to withdraw it in opposition to the action of a spring 10.

The cam 7 drives, through the agency of a keyed pin 11, the movable part 12 of a rotary switch having fixed contacts 13. The assembly produces the unlocking of the steering column by withdrawal of the bolt member 9 and the supply of electric power to the various parts. In particular, the rotation of the barrel 1 brings, after the unlocking of the steering column, the switch 12–13 to the positions "off", "on" and "starter" in succession.

An object of the invention is to preclude passing twice from the on position to the starter position without first passing again to the off position, which corresponds to the stopping of the engine.

For this purpose, the stator 2 has a recess 14 in which there is fixed a spring blade or strip 15 which is parallel to the axis of rotation of the rotor 1. The disc 5 has, on the side thereof opposed to the dog 6, a peripheral abutment 16 and a profile 17.

The shape and the function of the members 16 and 17 will be explained better with reference to the developed diagram shown in FIG. 3, in which, for the purposes of illustration, the profile 17 is shown to be fixed and the spring blade 15 movable relative thereto. The spring blade 15 has the position R at rest. It can be shifted to each side of this position R by cooperation of one of its lateral faces with the profile 17.

The profile 17 has two regions 18 and 19 which are interconnected at their ends 20 and 21. Each region 18 and 19 extends on each side of the position of rest R of the blade 15. The abutment 16, located in the vicinity of the end 21, also extends on each side of the position of rest R and is extended, in the direction away from the profile 17, by a bearing region 22.

The device operates in the following manner:

Starting at the position A (off) in which the blade 15 is in the position of rest I, the rotatable part of the anti-theft device is rotated in the clockwise direction to the position M (on). In the course of this rotation, the region 19 of the profile 17 encounters the blade 15 (position II) and this blade is made by the profile to move from its position of rest. When the rotation brings the end 21 of the profile 17 to a position in which it escapes from the blade 15 (position III) this blade cannot return to its position of rest since it is intercepted by the bearing region 22 (position IV). In continuing the rotation, the assembly reaches the position V corresponding to the actuation of the starter; this position D is obtained by means of an abutment (not shown).

When the user lets go of the key, a torsion spring (not shown) biases the assembly in the opposite direction. The blade slides on the bearing region 22, passes again through the position IV and escapes from this bearing region (IV) and returns to its position of rest (VII). This angular position corresponds to the normal operation (M) of the vehicle. If the user wishes to once again actuate the starter by turning the key in the clockwise direction, the movable part bears by the abutment 16 against the edge of the blade 15 in position VII and this rotation is prevented.

On the other hand, if the user then turns the key in the counterclockwise direction, the portion 18 of the profile 17 encounters the blade 15 (position VIII) and this blade is moved away from its position of rest in the opposite direction to its previous movement. When the anti-theft device reaches the off position A (position IX), the blade 15 escapes from the profile 17 and returns to its position of rest I. The cycle just described can now recommence.

The foregoing shows that the blade 15 could just as well be integral with the rotatable part and the profile integral with the fixed part. The displacement of the blade 15 could be longitudinal instead of radial as in the embodiment shown in FIGS. 1 and 2.

Figure 5:
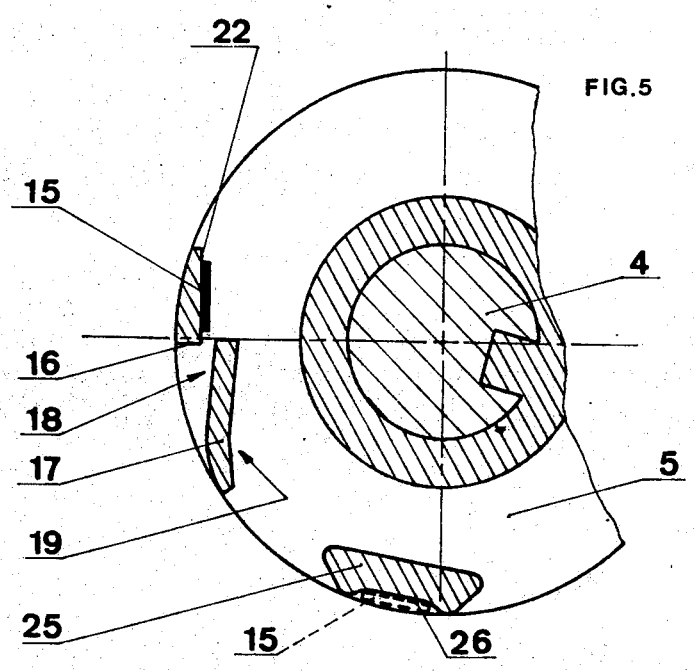
FIG. 5 is a sectional view taken on line V—V of FIG. 4.

In the embodiment shown in FIGS. 4 and 5, the bolt member 9 is displaced in a direction parallel to the axis of the anti-theft device. The blade 15 is mounted on this bolt member by a rivet 23 and is bent so as to pass through an opening 24 of the bolt member. The blade 15 therefore only comes in the region of the disc 5 when the bolt member has been withdrawn.

Further, the disc 5 has, in a given angular position (for example the position "accessories"), an indexing surface 25 provided with a recess 26 facing inwardly. The passage of the blade 15 into the recess 26 produces a resistance to the rotation of the rotatable part, which indicates to the user that he is in the indexed position.

Figure 6:
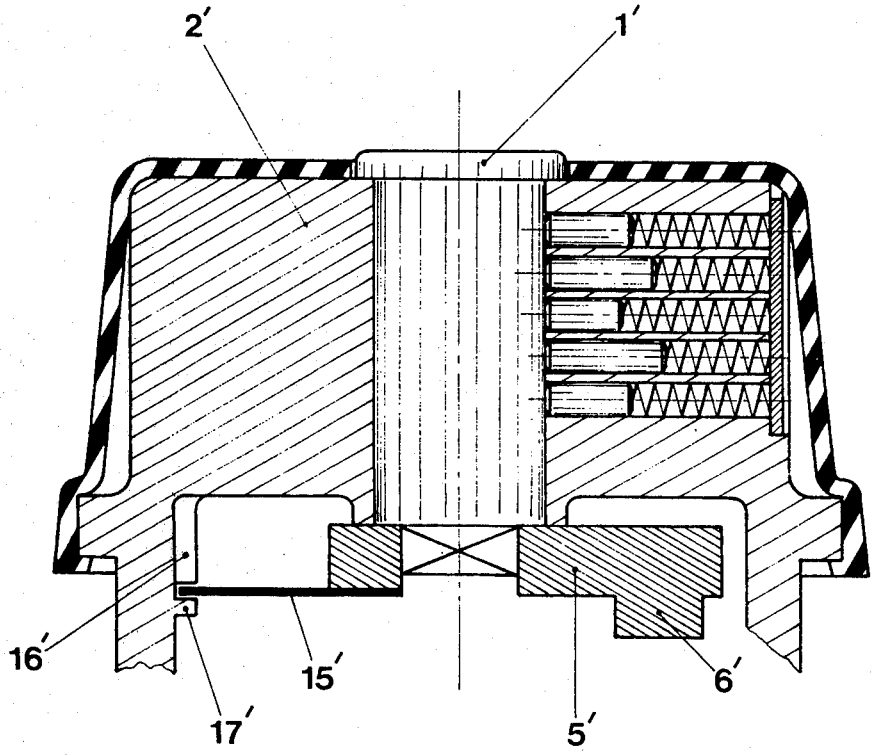
FIG. 6 is an axial sectional view of a part of the modification of the assembly according to this invention.

In the embodiment of FIG. 6 the spring blade 15' is secured to the disc 5' which, of course, is movable with barrel 1'. The disc 5' of course has a dog 6' cooperating in any convenient fashion to operate a bolt or other element. With this embodiment the profile or cam means 17' and the abutment means 16' are formed upon a stationary body of the lock device. The operation of the embodiment of FIG. 6 is in large part similar to that of FIGS. 1 and 2, but, of course, the follower constituted by spring blade 15' moves with the rotary element of the safety device whereas the profile or cam means 17' is fixed.

What is claimed is:

1. A safety device for a rotary starter switch comprising a rotatable part and a fixed part, said rotatable part being movable relative to said fixed part between an operative, starter operating position, and an inoperative, engine stopped, position, cam means on one of said parts and resilient follower means on the other of said parts, said follower means flexing during relative rotation of said parts to cooperate with said cam means, said cam means being effective to cause said follower means to follow a first path relative to said one of said parts as said rotatable part moves from said inoperative to said operative position, and a second path as said rotatable part moves from said operative to said inoperative position, and abutment means on said one part, cooperating with said follower means to preclude movement of said follower means on said second path to said operative position, said follower means comprising a spring blade, an edge region of said blade cooperating with said abutment means, and said blade being fixedly secured to the other of said parts.

2. A device as claimed in claim 1, wherein said spring blade is stationary relative to said fixed part.

3. A device as claimed in claim 1, wherein said spring blade is connected to rotate with said rotatable part.

4. A device as claimed in claim 2, wherein said spring blade is integral with a locking bolt member actuated by the rotation of said rotatable part.

5. A device as claimed in claim 1 wherein said spring blade is substantially perpendicular to the axis about which said rotatable part turns.

6. A device as claimed in claim 1, wherein said spring blade is substantially parallel to the axis about which said rotatable part turns.

7. A device as claimed in claim 1, wherein said part carrying said cam means has an indexing surface provided with a radial recess disposed in the path of said spring blade with respect to said one of said parts.

* * * * *